US010112392B2

(12) United States Patent
Tomimatsu et al.

(10) Patent No.: US 10,112,392 B2
(45) Date of Patent: Oct. 30, 2018

(54) LIQUID EJECTING HEAD AND LIQUID EJECTING APPARATUS

(71) Applicant: SEIKO EPSON CORPORATION, Tokyo (JP)

(72) Inventors: Shingo Tomimatsu, Matsumoto (JP); Shunsuke Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/428,887

(22) Filed: Feb. 9, 2017

(65) Prior Publication Data

US 2017/0151786 A1 Jun. 1, 2017

Related U.S. Application Data

(63) Continuation of application No. 14/966,909, filed on Dec. 11, 2015, now Pat. No. 9,604,455.

(30) Foreign Application Priority Data

Jan. 29, 2015 (JP) ..... 2015-015109

(51) Int. Cl.
*B41J 2/14* (2006.01)

(52) U.S. Cl.
CPC ..... *B41J 2/14274* (2013.01); *B41J 2/14233* (2013.01); *B41J 2002/14241* (2013.01); *B41J 2002/14362* (2013.01); *B41J 2202/11* (2013.01)

(58) Field of Classification Search
CPC ..... B41J 2/14233; B41J 2/14274; B41J 2002/11; B41J 2002/14362; B41J 2002/14241
See application file for complete search history.

(56) References Cited

U.S. PATENT DOCUMENTS

| | | | | |
|---|---|---|---|---|
| 7,156,510 | B2 | 1/2007 | Hilton et al. | |
| 2005/0036011 | A1 | 2/2005 | Watanabe | |
| 2006/0181582 | A1* | 8/2006 | Sugahara | B41J 2/14233 347/70 |
| 2007/0263041 | A1 | 11/2007 | Owaki | |
| 2010/0123759 | A1 | 5/2010 | Matsui et al. | |
| 2016/0221338 | A1 | 8/2016 | Tomimatsu et al. | |

FOREIGN PATENT DOCUMENTS

| | | |
|---|---|---|
| JP | 2005059328 | 3/2005 |
| JP | 2007-301736 | 11/2007 |
| JP | 2012210771 | 11/2012 |

OTHER PUBLICATIONS

U.S. Appl. No. 14/966,909, May 10, 2016, Office Action.
U.S. Appl. No. 14/966,909, Nov. 21, 2016, Notice of Allowance.

* cited by examiner

*Primary Examiner* — Sharon A Polk
(74) *Attorney, Agent, or Firm* — Workman Nydegger

(57) ABSTRACT

A liquid ejecting head includes a plurality of stacked substrates that include a nozzle substrate having a nozzle from which liquid is ejected. A channel is formed in at least a part of the substrates and guides the liquid to the nozzle. The channel includes: a first channel that extends in an X direction intersecting a stacking direction in which the substrates are stacked; a curved section curved in a Z direction that intersects the X direction and contains a component of the stacking direction; and a second channel that extends from the curved section in the Z direction. A wall is formed in a corner portion inside the channel so as to intersect both the X and Z directions, and the corner portion is formed in the curved section between the inside walls of the first and second channels.

14 Claims, 11 Drawing Sheets

LIQUID EJECTING HEAD AND LIQUID EJECTING APPARATUS

This application is a Continuation of U.S. application Ser. No. 14/966,909 filed Dec. 11, 2015, which is expressly incorporated herein by reference. The entire disclosure of Japanese Patent Application No. 2015-015109, filed Jan. 29, 2015, is expressly incorporated by reference herein.

BACKGROUND

1. Technical Field

The present invention relates to a liquid ejecting head and a liquid ejecting apparatus equipped with the liquid ejecting head.

2. Related Art

Ink jet printers are known examples of liquid ejecting apparatuses. A typical ink jet printer can print images on an arbitrary recording medium, such as a sheet of paper or cloth, by ejecting liquid onto the recording medium through a liquid ejecting head, more specifically ejecting ink through a recording head. Some recording heads known in the art have a structure in which a plurality of substrates are stacked on top of each other (e.g., Japanese Patent No. 4,258,668).

In the recording head disclosed by Japanese Patent No. 4,258,668, a reservoir and a through-hole are formed in a protective substrate so as to cross each other; the protective substrate is one of a plurality of stacked substrates. This through-hole passes through the stacked substrates and reaches the reservoir while being curved. The protective substrate is made of a monocrystalline silicon substrate, and the reservoir and the through-hole are formed in the protective substrate by subjecting the monocrystalline silicon substrate to an etching process. Both the reservoir and the through-hole form an ink channel, which is usually angled in a corner formed between the inside walls of the reservoir and the through-hole. If the channel has an angled corner, the ink is prone to stagnate in this angled corner. In addition, bubbles generated inside the channel are prone to stay in the angled corner. If bubbles are generated inside a channel in an ink jet printer, the bubbles may clog nozzles or cause uneven printing, which leads to a lowered printing property of the ink jet printer. Although it is preferable for bubbles to be purged promptly from a channel in a recording head, the bubbles tend to stay in a corner of the channel. In short, existing liquid ejecting heads have difficulty purging bubbles readily from a channel.

SUMMARY

An advantage of some aspects of the invention is that a liquid ejecting head and a liquid ejecting apparatus equipped with the liquid ejecting head are capable of addressing at least a part of the above disadvantage. The liquid ejecting head and liquid ejecting apparatus can be embodied by embodiments and their modifications that will be described below.

First Aspect

A liquid ejecting head includes a plurality of substrates stacked on top of each other which include a nozzle substrate having a nozzle formed therein, liquid being ejected from the nozzle. A channel is formed in at least a part of the plurality of substrates and guides the liquid to the nozzle. The channel includes: a first channel extending in a first direction intersecting a stacking direction, the stacking direction being a direction in which the plurality of substrates are stacked; a curved section curved in a second direction intersecting the first direction, the second direction containing a component of the stacking direction; and a second channel extending from the curved section in the second direction. A wall is formed in a corner portion inside the channel so as to intersect both the first direction and the second direction, and the corner portion is formed in the curved section between an inside wall of the first channel and an inside wall of the second channel.

According to the liquid ejecting head of the first aspect, the channel that guides the liquid to the nozzle includes the curved section curved in the second direction from the first direction. Since the wall is formed in the corner portion of the curved section so as to intersect both the first and second directions, the liquid flowing along the channel is guided smoothly by the wall in the curved section. When the liquid that has flown in the first direction is curved in the corner portion and flows in the second direction, the liquid is less likely to stay in the corner portion. Therefore, assuming that bubbles are generated in the channel, the bubbles pass smoothly through the curved section along with the liquid flow. Thus, bubbles generated in the channel are purged readily through the nozzle.

Second Aspect

In the liquid ejecting head of the first aspect, a width of the wall in a direction intersecting the first direction when the wall is viewed as a plane from the stacking direction is preferably larger than both a width of the first channel in the second direction and a width of the second channel in the first direction.

According to the second aspect, the widths of the first channel, the curved section, and the second channel in the direction intersecting the first direction when the wall is viewed as a plane from the stacking direction are each larger than both the width of the first channel in the second direction and the width of the second channel in the first direction. The first channel, the curved section, and the second channel thereby can have a large cross section. Consequently, it is possible to cause the liquid to flow through the first channel, the curved section, and the second channel at a higher rate. In addition, the increase in the sectional area of the channel results in a decrease in its pipe resistance, making it possible to supply the liquid to the nozzle more effectively.

Third Aspect

In the liquid ejecting head of the first or second aspect, the second direction is preferably the stacking direction.

According to the third aspect, the second channel extends in the stacking direction. The first channel thereby can be connected to the second channel to which a through-channel (described later) is connected, so as to form the shortest path in the stacking direction. By shortening the second channel, the liquid and bubbles in the channel can be purged therefrom within a short period of time.

Fourth Aspect

In the liquid ejecting head of one of the first to third aspects, assuming that the first channel, the curved section, and the second channel are cut along a plane defined by the first direction and the second direction, a width of a cross section of the wall in the second direction is preferably equal to one-quarter a width of a cross section of the first channel in the second direction or more than one-quarter the width of the cross section of the first channel in the second direction.

According to the fourth aspect, the liquid flowing along the channel can be guided easily along the wall of the curved section.

Fifth Aspect

In the liquid ejecting head of one of the first to fourth aspects, the plurality of substrates preferably include a resin substrate made of a resin material, and at least a part of the first channel, the curved section, and at least a part of the second channel are preferably formed in the resin substrate.

According to the fifth aspect, the flow of the liquid can be curved by the curved section formed in the resin substrate.

Sixth Aspect

In the liquid ejecting head of one of the first to fifth aspects, the wall preferably has a curved surface.

According to the sixth aspect, the liquid can be guided along the curved surface of the wall. By forming the cover section into a curved shape whose orientation gradually changes, the liquid can be guided more smoothly in the second direction.

Seventh Aspect

In the liquid ejecting head of one of the first to fifth aspects, the wall preferably has a flat surface.

According to the seventh aspect, the liquid can be guided along the flat surface of the wall.

Eighth Aspect

A liquid ejecting apparatus includes the liquid ejecting head of one of the first to seventh aspects.

According to the eighth aspect, the liquid ejecting apparatus reduces the risk that the liquid stays in the corner portion when the liquid that has flown along the channel in the first direction is curved in the second direction in the corner portion. Therefore, assuming that bubbles are generated in the channel, the bubbles pass smoothly through the curved section along with the liquid flow. Thus, bubbles generated in the channel are purged readily through the nozzle.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
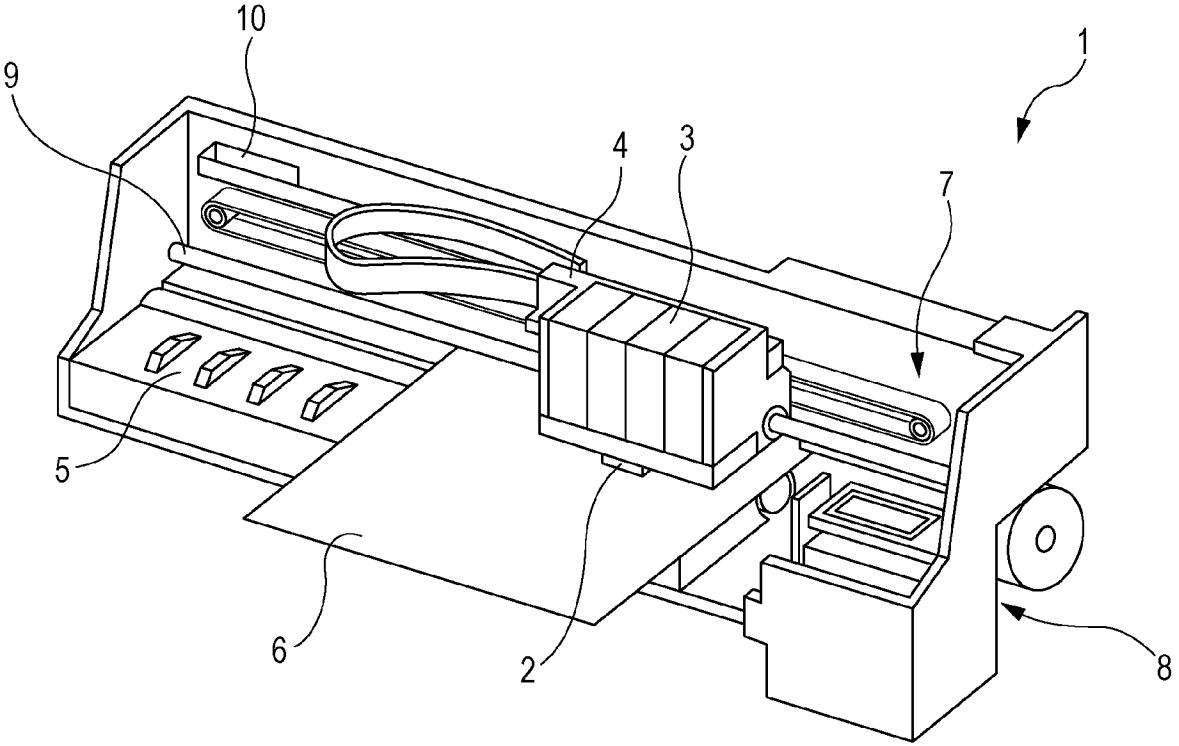
FIG. 1 is a schematic view of an ink jet recording apparatus in a first embodiment.

Some embodiments of the invention will be described below with reference to the accompanying drawings. It should be noted that the scaling of layers and members illustrated in the drawings differs from a real one, and some layers and members are enlarged so as to be distinguishable from one another. Embodiments, which are specific examples of the invention, have various limitations. However, these limitations are not intended to narrow the scope of the invention unless defined otherwise.

First Embodiment

An ink jet recording apparatus 1 illustrated in FIG. 1 is an exemplary liquid ejecting apparatus. This ink jet recording apparatus 1 is referred to below as a printer 1.

The printer 1 includes an ink jet recording head unit 2, which is an exemplary liquid ejecting head; the ink jet recording head unit 2 is referred to below as a head unit 2. The head unit 2 can eject liquid, more specifically ink, in droplet form. In the printer 1, the head unit 2 and ink cartridges 3 are mounted in a carriage 4. A platen 5 is disposed below the head unit 2. A carriage moving mechanism 7 moves the carriage 4 in sheet width directions of a recording sheet 6 that is a target on which ink ejected from nozzles 32 is to land. The sheet width directions are main-scanning directions in which the head unit 2 reciprocates. A sheet feeding mechanism 8 transports the recording sheet 6 in a sheet feeding direction, which is orthogonal to the sheet width directions. The sheet feeding direction is a sub-scanning direction that is orthogonal to the main-scanning directions of the head unit 2.

The carriage 4 is attached to the printer 1 while being supported by a guide rod 9 extending in the main-scanning directions and is moved along the guide rod 9, or in the main-scanning directions, by the carriage moving mechanism 7. The position of the carriage 4 in the main-scanning directions is detected by a linear encoder 10, which then transmits a detection signal to a controller (not illustrated) as positional information. The controller thereby can control recording, ink ejection and some other operations by causing the head unit 2 to eject ink droplets while recognizing a position of the moving carriage 4 (head unit 2) on the basis of the positional information from the linear encoder 10.

In the foregoing embodiment, a liquid ejecting head is exemplified by an ink jet recording head. Ink jet recording heads are, however, applicable to various manufacturing apparatuses, thanks to a feature of causing a very small amount of ink to land accurately at a desired site. Examples of such manufacturing apparatuses include: display manufacturing apparatuses that manufacture color filters for liquid crystal displays (LCDs) and the like; electrode forming apparatuses that form electrodes for organic electroluminescence (EL) displays, FEDs (surface emitting diode displays), and the like; and chip manufacturing apparatuses that manufacture biochips. When a liquid ejecting head is used as a recording head for an image recording apparatus, the liquid ejecting head ejects liquid ink. When a liquid ejecting head is used as a color material ejecting head for a display manufacturing apparatus, the liquid ejecting head ejects color material solutions for R (red), G (green) and B (blue). When a liquid ejecting head is used as an electrode material ejecting head for an electrode forming apparatus, the liquid ejecting head ejects a liquid electrode material. When a liquid ejecting head is used as a bioorganic substance ejecting head for a chip display manufacturing apparatus, the liquid ejecting head ejects the solution of a bioorganic substance.

Figure 2:
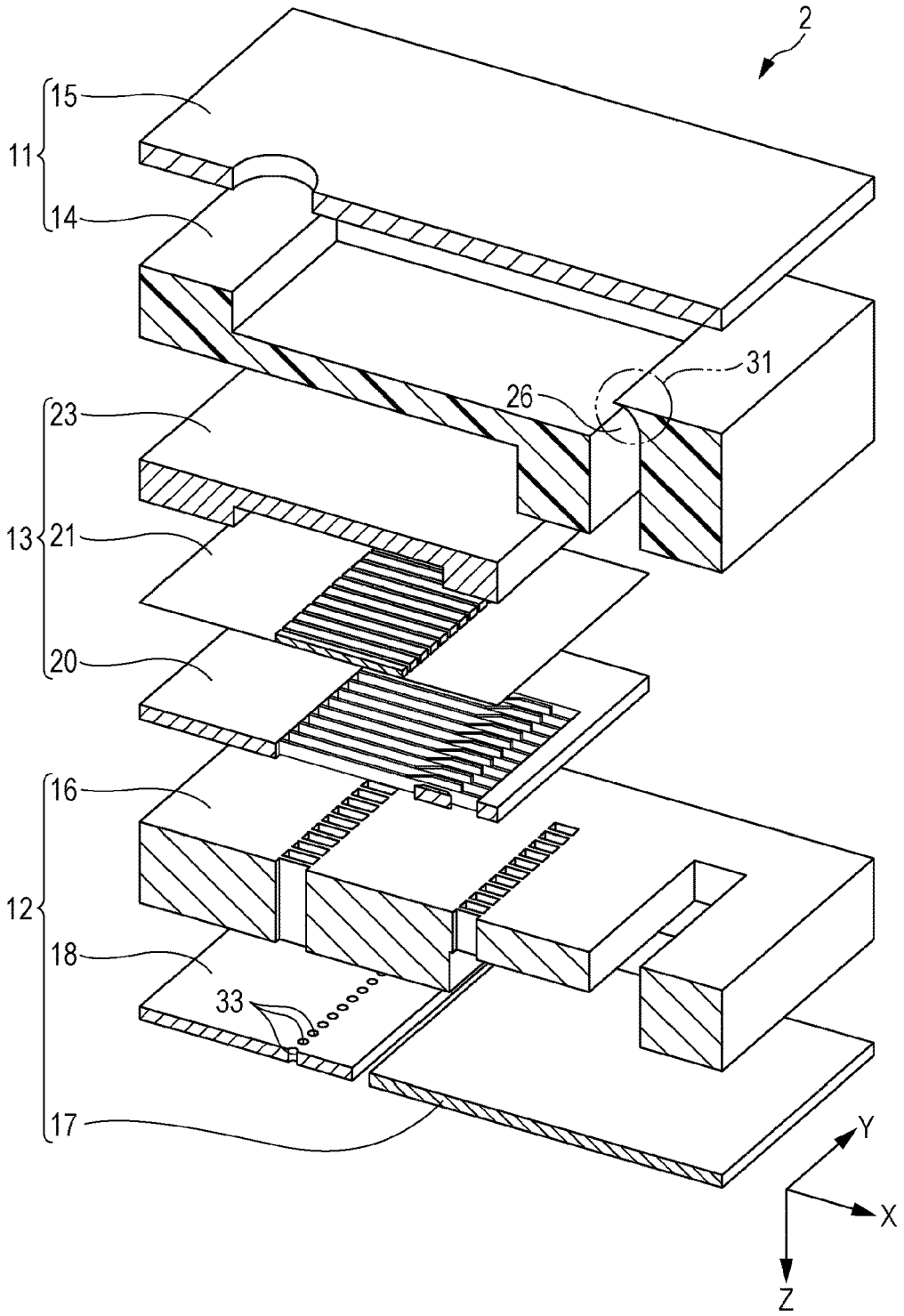
FIG. 2 is an exploded perspective view of the head unit in the first embodiment.

FIG. 2 is an exploded perspective view of the head unit 2. The head unit 2 in the first embodiment includes a lower channel unit 12, a pressure generating unit 13, and an upper channel unit 11, which are all stacked on top of each other. The upper channel unit 11 includes a case substrate 14 and an upper sealing substrate 15, which are both stacked on top of each other. The lower channel unit 12 includes a communicating substrate 16, a lower sealing substrate 17, and a nozzle substrate 18. The pressure generating unit 13 includes a pressure chamber forming substrate 20 having pressure chambers 19 formed therein, an elastic film 21, piezoelectric elements 22, and a protective substrate 23, which are all stacked on top of each other, constituting a single unit. In short, the head unit 2 includes a plurality of stacked substrates. The plurality of stacked substrates are the nozzle substrate 18, the communicating substrate 16, the pressure chamber forming substrate 20, the protective substrate 23, the case substrate 14, and the upper sealing substrate 15. In addition, the plurality of nozzles 32 are formed in the nozzle substrate 18.

Figure 3:
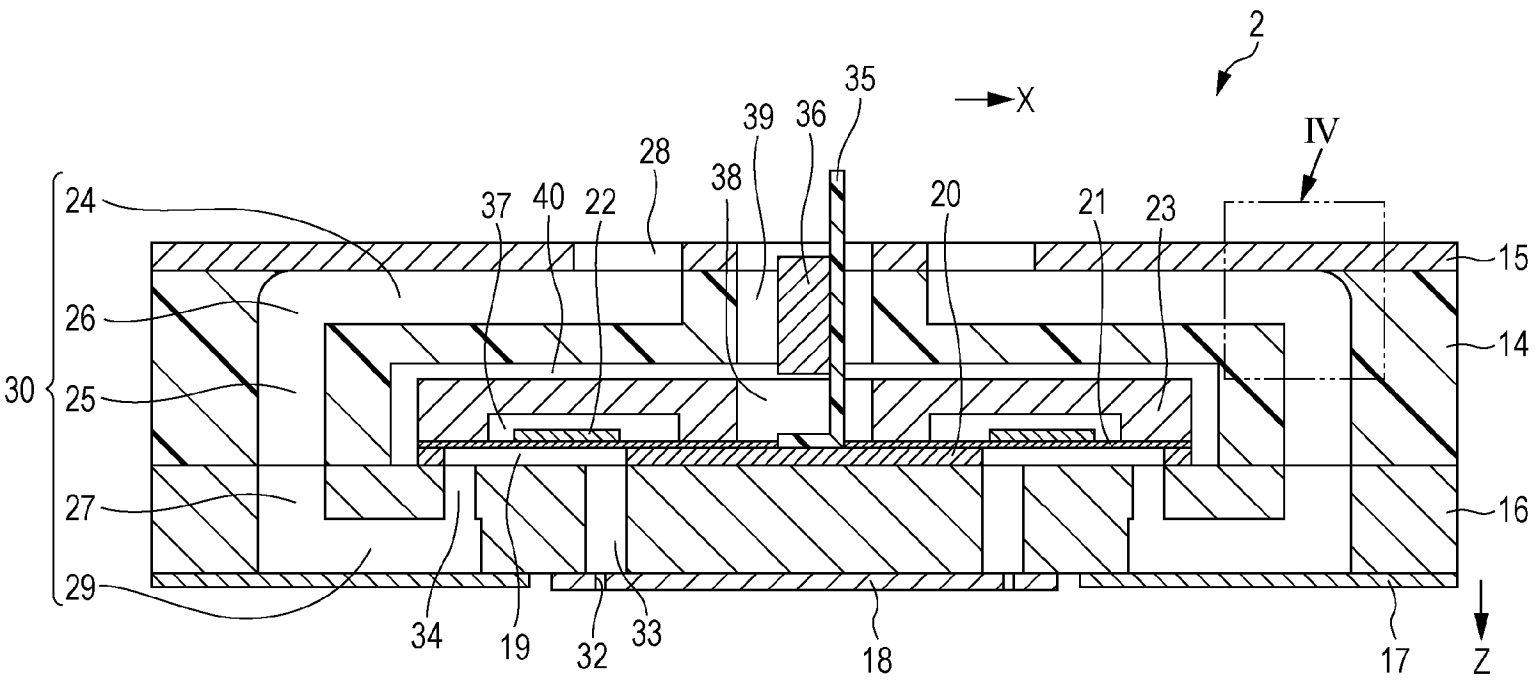
FIG. 3 is a sectional view of the head unit in the first embodiment.
Figure 4:
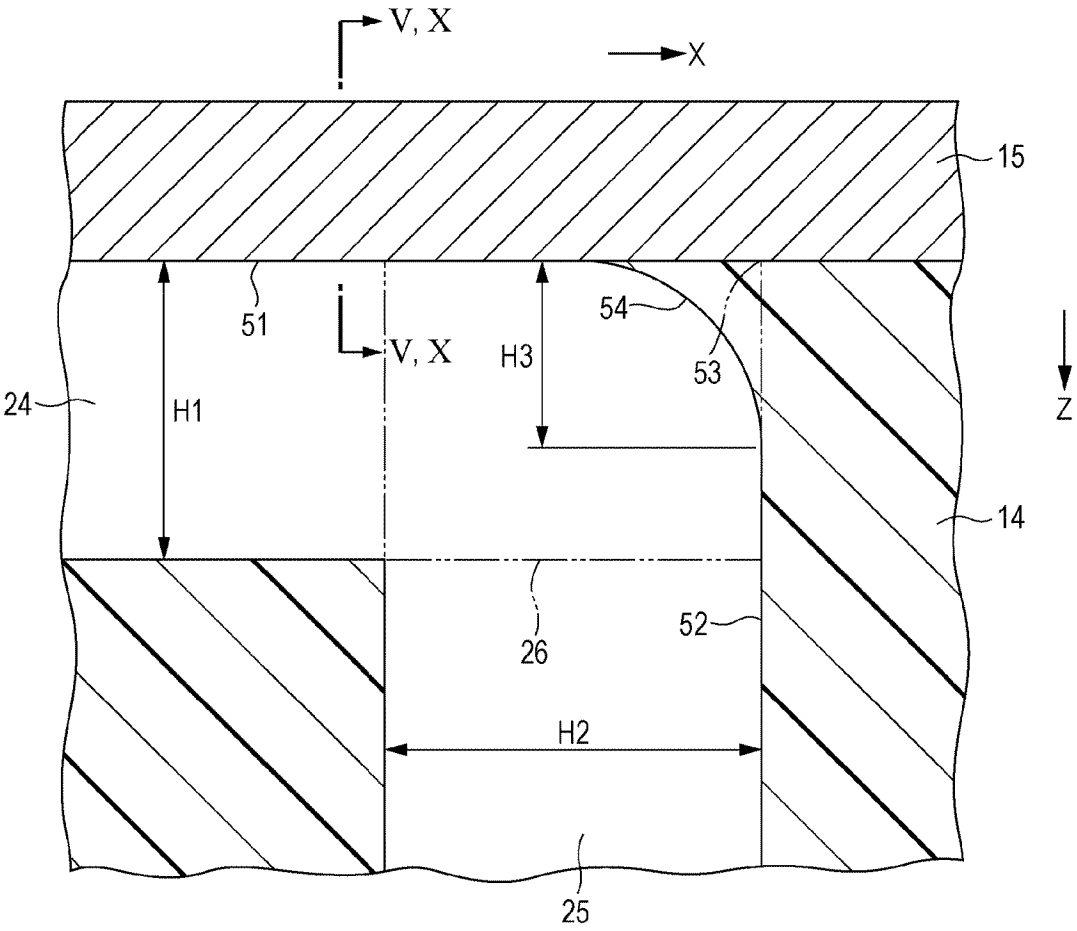
FIG. 4 is an enlarged view of the area IV in FIG. 3.
Figure 5:
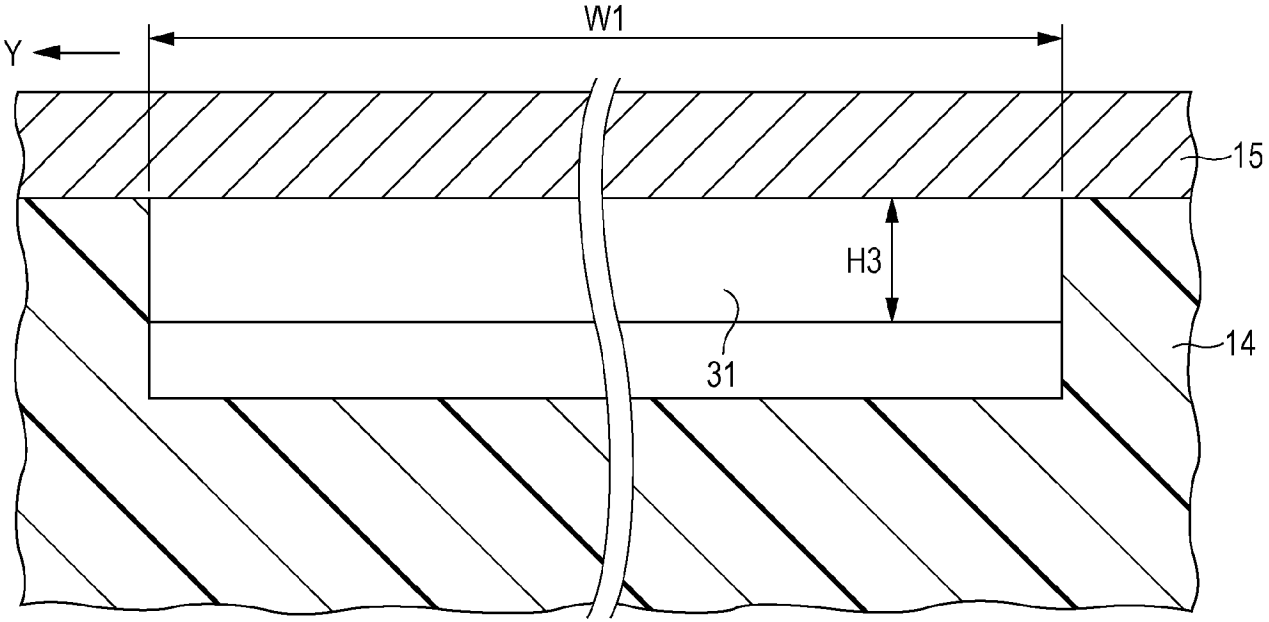
FIG. 5 is a sectional view taken along the line V-V in FIG. 4.

FIG. 3 is a sectional view of the head unit 2. FIG. 4 is an enlarged view of the area IV in FIG. 3. FIG. 5 is a sectional view taken along the line V-V in FIG. 4.

The direction in which the plurality of nozzles 32 are arrayed is defined as a Y direction. The direction in which the plurality of substrates are stacked (referred to below as a stacking direction) is defined as a Z direction. The direction that is orthogonal to both the Y and Z directions is defined as an X direction. Herein, X, Z, and Y directions correspond to first, second, and third directions, respectively. In the drawings, the direction of each arrow is defined as a positive (+) direction, whereas the opposite direction is defined as a negative (−) direction.

As illustrated in FIG. 3, first channels 24 and second channels 25 are formed in the case substrate 14, which is a constituent member of the upper channel unit 11. The first channels 24 intersect the second channels 25 in curved sections 26. The first channels 24 extend in the X direction, whereas the second channels 25 extend in a direction that contains a component of the above stacking direction and interests the X direction. In short, the channels in the head unit 2 are each formed of a first channel 24, a curved section 26, and a second channel 25. Each first channel 24 extends in the X direction. Each curved section 26 is curved in a direction that intersects the X direction and contains the component of the stacking direction. Each second channel 25 extends from a corresponding curved section 26 in a direction that intersects the X direction and contains the component of the stacking direction. In the first embodiment, the direction that intersects the X direction and contains the component of the stacking direction corresponds to the Z direction. Hence, each second channel 25 extends in the Z direction.

As illustrated in FIG. 4, a first channel 24 has a height H1 in the Z direction, whereas a second channel 25 has a height H2 in the X direction. The first channel 24 and the second channel 25 form a curved section 26 and are interconnected via the curved section 26. As illustrated in FIG. 3, the second channels 25 are connected to through-channels 27 that will be described later, whereby the first channels 24 are connected to the through-channels 27. The case substrate 14 may be made of a material that can be molded readily, such as a resin. The case substrate 14 in the first embodiment may be formed by injection-molding a resin.

As illustrated in FIG. 3, the second channels 25 extend from the upper sealing substrate 15 to the lower sealing substrate 17. Therefore, the first channels 24 and the through-channels 27 are interconnected in the stacking direction (Z direction) so as to form the shortest path. This can decrease the total length of the channels. Consequently, since the ink flows through a short channel, bubbles in this channel could be purged therefrom within a short period of time.

The upper sealing substrate 15 is bonded to the surface of the case substrate 14 from which the first channels 24 are open, thereby sealing the openings of the first channels 24. The upper sealing substrate 15 has ink introducing paths 28, which are formed across the upper sealing substrate 15 in a thickness direction thereof (Z direction). The inks in the ink cartridges 3 (see FIG. 1) are introduced into the head unit 2 through the ink introducing paths 28. The inks that have been introduced through the ink introducing paths 28 are supplied to common liquid chambers 30, each of which includes a first channel 24, a curved section 26, a second channel 25, a through-channel 27, and a common communicating path 29. Then, the inks that have been supplied to the common liquid chambers 30 are ejected onto the recording sheet 6 in droplet form through the nozzles 32.

As illustrated in FIG. 4, the curved section 26 formed in the upper channel unit 11 by the first channel 24 and the second channel 25 has a wall 54 formed therein. The wall 54 intersects a corner portion 53 in both the X and Z directions; the corner portion 53 is formed between an inside wall 51 of the first channel 24 and an inside wall 52 of the second channel 25. As illustrated in FIG. 4, the corner portion 53 in the first embodiment which is formed between the inside walls 51 and 52 is formed in the curved section 26 by the upper sealing substrate 15 and the case substrate 14. In other words, the corner portion 53 formed between the inside walls of a channel is formed between the inside walls 51 and 52 in the channel.

As illustrated in FIG. 2, a cover section 31 is formed in the curved section 26 in the case substrate 14. This cover section 31 protrudes from the inside walls 52 of the second channels 25 toward the first channels 24 (see FIG. 4). The above wall 54 forms the inside wall of the cover sections 31. As illustrated in FIG. 5 that is a sectional view taken along the line V-V in FIG. 4, the cover section 31 has a width W1 in the Y direction. The width W1 of the cover section 31 is preferably greater than both the heights H1 and H2 (see FIG. 4) of the first channel 24 and the second channels 25, respectively. This can increase the sectional areas of the first channel 24, the curved section 26, and the second channel 25. Consequently, it is possible to cause the inks to flow through the first channels 24, the curved sections 26, and the second channels 25 at a higher rate. Since the increase in the sectional area of a channel results in a decrease in its pipe resistance, it is possible to decrease the pressure loss, and thus supply the inks to the nozzles 32 more effectively.

The pressure chamber forming substrate 20 illustrated in FIG. 2, which is a constituent member of the pressure generating unit 13, may be made of a crystalline substrate, more specifically a monocrystalline silicon substrate; the monocrystalline silicon substrate will also be referred to as a silicon substrate. The pressure chamber forming substrate 20 is provided with the plurality of pressure chambers 19, which are formed by subjecting the silicon substrate to an anisotropic etching process. These pressure chambers 19 correspond to the nozzles 32 in the nozzle substrate 18 as will be described later. By employing the anisotropic etching process, the pressure chambers 19 in the silicon substrate can be formed with high dimensional accuracy. The nozzle substrate 18 in the first embodiment (see FIG. 3) is provided with two arrays of nozzles 32. In relation to these nozzle arrays, two arrays of pressure chambers 19 are formed in the pressure chamber forming substrate 20. Each pressure chamber 19 is a narrow space that extends in the X direction along which the nozzles 32 are formed.

When the pressure chamber forming substrate 20 (pressure generating unit 13) is bonded to the communicating substrate 16 while their relative position is adjusted, first ends of the pressure chambers 19 in the X direction communicate with the corresponding nozzles 32 via nozzle communicating paths 33, which will be described later, in the communicating substrate 16, as illustrated in FIG. 3. Second ends of the pressure chambers 19 in the X direction communicate with corresponding common liquid chambers 30 (common communicating path 29) via supply-side individual communicating paths 34 in the communicating substrate 16. In this configuration, the common liquid chambers 30 provided with the first channels 24 and the second channels 25, the supply-side individual communicating paths 34, the pressure chambers 19, and the nozzle communicating paths 33 constitute the channels of the inks which extend from the ink introducing paths 28 to the nozzles 32.

The communicating substrate 16, which is a constituent member of the lower channel unit 12, may be made of a silicon substrate. This communicating substrate 16 is provided with through-channels 27; the through-channels 27 are parts of the common liquid chambers 30 and formed with an anisotropic etching process, for example, so as to pass through the communicating substrate 16 in a thickness direction thereof. Furthermore, the supply-side individual communicating paths 34 and the nozzle communicating paths 33 are formed in the communicating substrate 16 at the center relative to the through-channels 27. The supply-side individual communicating paths 34 and the nozzle communicating paths 33 are positioned corresponding to the pressure chambers 19 and are formed with an anisotropic etching process, for example, so as to pass through the communicating substrate 16 in a thickness direction thereof. The common communicating paths 29 are formed between the supply-side individual communicating path 34 and the through-channel 27 with a half etching process, for example. The through-channels 27 communicate with the supply-side individual communicating paths 34 via the common communicating paths 29. Openings of the common communicating paths 29 and the through-channels 27 are sealed by the lower sealing substrate 17. However, openings in a part of the communicating substrate 16 which is bonded to the nozzle substrate 18 that will be described later are not covered by the lower sealing substrate 17. This is because the communicating substrate 16 is bonded to the nozzle substrate 18 at the center relative to the openings of the common communicating paths 29 and the through-channels 27.

The nozzle substrate 18 illustrated in FIG. 2, which is a constituent member of the lower channel unit 12, is provided with the plurality of nozzles 32 arranged in lines and at spacings corresponding to the density of dots to be created during a printing operation. The nozzle substrate 18 in the first embodiment is provided with two nozzle arrays (see FIG. 3). The nozzle substrate 18 may be made of a silicon substrate, and the nozzles 32 are each formed into a circular shape with a dry etching process, for example. By bonding the nozzle substrate 18 to the surface of the communicating substrate 16 in which openings are formed while their relative position is adjusted, the nozzles 32 are made to communicate with the corresponding pressure chambers 19 via the nozzle communicating paths 33.

As illustrated in FIG. 3, the elastic film 21 is formed on the upper surface of the pressure chamber forming substrate 20; this upper surface is opposite to that bonded to the communicating substrate 16. The elastic film 21 seals the openings in the upper surface of the pressure chamber 19. The elastic film 21 may be made from silicon dioxide and have a thickness of approximately 1 μm. The elastic film 21 has a dielectric film (not illustrated) formed thereon which may be made from zirconium oxide. Furthermore, the piezoelectric elements 22 are formed on the dielectric film over the elastic film 21 at locations corresponding to the pressure chambers 19. The piezoelectric element 22 may have the so-called flexible vibration mode of a piezoelectric element. To form each piezoelectric element 22, a lower electrode film made of a metal, a piezoelectric body layer made of lead zirconate titanate (PZT) and the like, and an upper electrode film made of a metal (all not illustrated) may be stacked on the dielectric film over the elastic film 21 in this order and then subjected to patterning for each pressure chamber 19. Further, one of the upper and lower electrode films may be formed as a common electrode, whereas the other may be formed as a separate electrode. The elastic film 21, the dielectric film, and the lower electrode film function as a diaphragm when the piezoelectric element 22 is driven.

Each piezoelectric element 22 has an electrode wiring portion (not illustrated) that extends from the separate electrode (upper electrode film) over the dielectric film. A part of the electrode wiring portion which serves as an electrode terminal is connected to a negative terminal of a flexible cable 35. The flexible cable 35 may be fabricated by forming a conductive pattern on a surface of a base film made of polyimide or the like with copper foil or the like and coating this conductive pattern with a resist. The flexible cable 35 has a drive IC 36 mounted thereon, and this drive IC 36 drives the piezoelectric elements 22. Each piezoelectric element 22 is deformed by the drive IC 36 applying a drive signal (voltage) between the upper electrode film and the lower electrode film.

As illustrated in FIG. 3, the protective substrate 23 is formed above the upper surface of the pressure chamber forming substrate 20 on which the piezoelectric elements 22 and the elastic film 21 are formed. The protective substrate 23 is a box-shaped hollow member whose lower surface is open and may be made of glass, a ceramic material, a monocrystalline silicon substrate, a metal, or a synthetic resin, for example. The protective substrate 23 has recesses 37 formed therein; the recesses 37 are formed opposite the piezoelectric elements 22 and have a size that is large enough to be able to prevent interference with the drive of the piezoelectric elements 22. The protective substrate 23 has a wiring space 38, which is made between the piezoelectric elements 22 disposed adjacent to each other and passes through the protective substrate 23 in a thickness direction thereof. The electrode terminals of the piezoelectric elements 22 and terminals of the flexible cable 35 are disposed within the wiring space 38.

The upper channel unit 11 has a through-space 39 (see FIG. 3) at its center in plan view. This through-space 39 is a narrow opening that extends in the Y direction (see FIG. 2) and in parallel with the arrays of the nozzles 32, and passes through both the case substrate 14 and the upper sealing substrate 15 in a thickness direction thereof. As illustrated in FIG. 3, the through-space 39 reaches the wiring space 38 of the pressure generating unit 13, making a space in which the terminals of the flexible cable 35 and the drive IC 36 are disposed. In addition, a storage space 40 is made in the case substrate 14 and extends from the lower surface of the upper channel unit 11 to the interior of the case substrate 14 at a predetermined location in a height direction thereof. The storage space 40 has a width that is slightly greater than the thickness (height) of the pressure generating unit 13. The size of the storage space 40 is slightly larger than the outside size of the pressure generating unit 13. When the lower channel unit 12 is bonded to the lower surface of the upper channel unit 11 while their relative position is adjusted, the pressure generating unit 13 stacked on the communicating substrate 16 is accommodated in the storage space 40. In this case, the through-space 39 is open toward the upper surface of the storage space 40.

When the head unit 2 configured above is manufactured, first, the elastic film 21 and the dielectric film are formed, in this order, on the upper surface of the pressure chamber forming substrate 20, or a silicon substrate in which no pressure chambers 19 are formed. Then, the piezoelectric elements 22 are formed with firing, and the protective substrate 23 is bonded to the dielectric film with the piezoelectric elements 22 accommodated in the recesses 37. After that, the pressure chambers 19 are formed in the lower surface of the pressure chamber forming substrate 20 with an anisotropic etching process. In this way, first the piezoelectric elements 22 and the protective substrate 23 are formed on the upper surface of the pressure chamber forming substrate 20 as a single unit, and then the pressure chambers 19 are formed in the pressure chamber forming substrate 20. This process can reduce the risk that the pressure chamber forming substrate 20 is damaged while the pressure generating unit 13 is being assembled.

Following the above, the nozzle substrate 18 is bonded to the lower surface of the communicating substrate 16 while the nozzle communicating paths 33 communicate with the corresponding nozzles 32. Moreover, the lower sealing substrate 17 is bonded to the lower surface of the communicating substrate 16 while the openings of the through-channels 27 and the common communicating paths 29 are close. As a result, the lower channel unit 12 is assembled as a single unit. Then, the case substrate 14 is bonded to the upper sealing substrate 15 with glue. In this way, the first channels 24 are sealed, and the ink introducing paths 28 formed in the upper sealing substrate 15 communicate with the corresponding first channels 24.

After the upper channel unit 11, the pressure generating unit 13, and the lower channel unit 12 have been individually assembled, the pressure generating unit 13 is bonded to the upper surface of the communicating substrate 16 in the lower channel unit 12. More specifically, while the first ends of the pressure chambers 19 in the X direction communicate with the corresponding nozzle communicating paths 33 and the second ends thereof in the X direction communicate with the corresponding supply-side individual communicating paths 34, the pressure chamber forming substrate 20 in the pressure generating unit 13 is bonded to the upper surface of the communicating substrate 16 with glue.

After the lower channel unit 12 and the pressure generating unit 13 have been bonded to each other, the flexible cable 35 passes through the wiring space 38 in the protective substrate 23 and is connected to the electrode terminals of the piezoelectric elements 22. In other words, the terminals of the flexible cable 35 are electrically connected to parts of the piezoelectric elements 22 which correspond to the electrode terminals.

Following the above, the communicating substrate 16 in the lower channel unit 12 is bonded to the case substrate 14 in the upper channel unit 11 with glue. By bonding the lower channel unit 12 to the upper channel unit 11, the pressure generating unit 13 is accommodated in the storage space 40 and the second channels 25 communicate with the corresponding through-channels 27. The common liquid chamber 30 constituted by the first channels 24, the curved sections 26, the second channels 25, the through-channels 27, and the common communicating paths 29 is thereby formed. The terminals of the flexible cable 35 and the drive IC 36 are accommodated in the through-space 39 of the upper channel unit 11. Through the processing described above, the head unit 2 can be assembled.

The head unit 2 includes common channels and individual channels formed therein. Components of each common channel are an ink introducing path 28 and a common liquid chamber 30 including a first channel 24 to a common communicating path 29. Components of each individual channel are a supply-side individual communicating path 34, a pressure chamber 19, a nozzle communicating path 33, and a nozzle 32.

Figure 6:
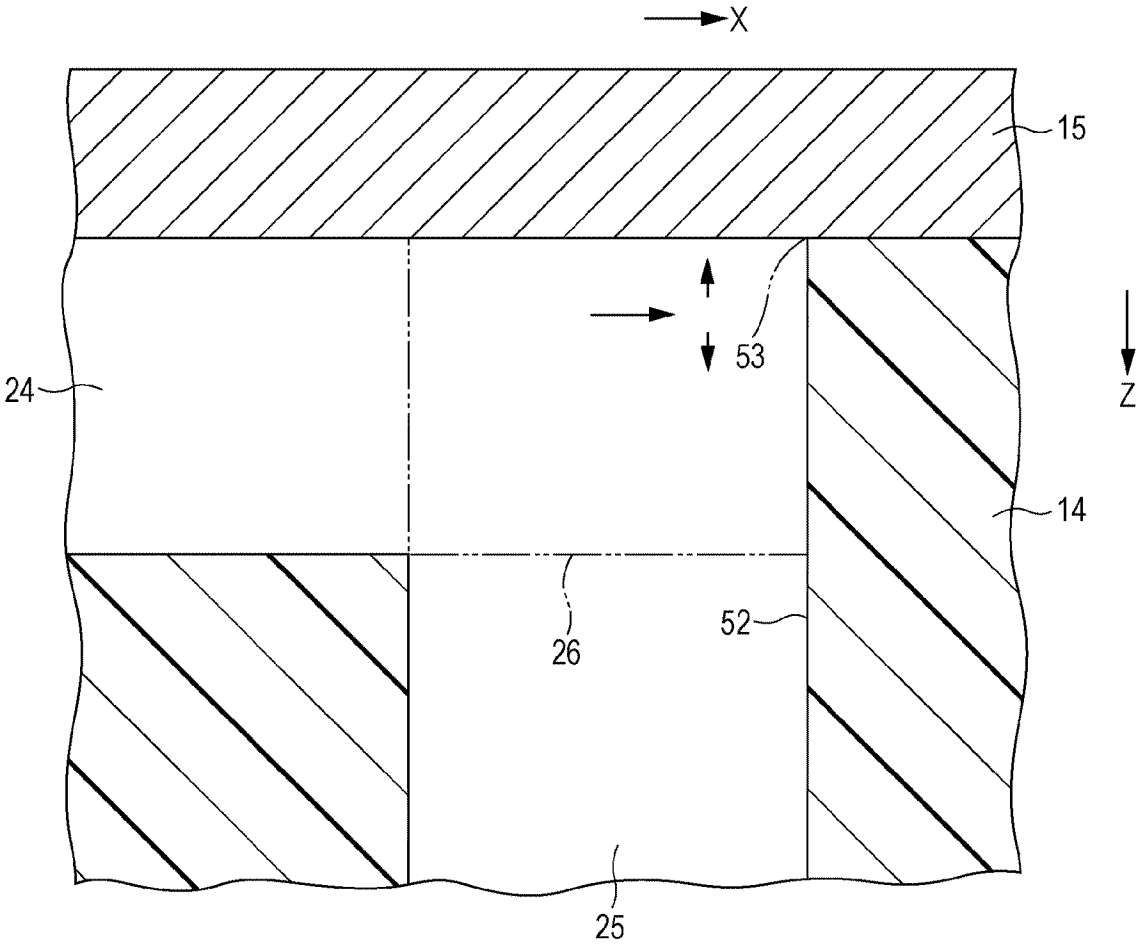
FIG. 6 is an illustrative view of the flow of liquid in a curved section in an existing technology.
Figure 7:
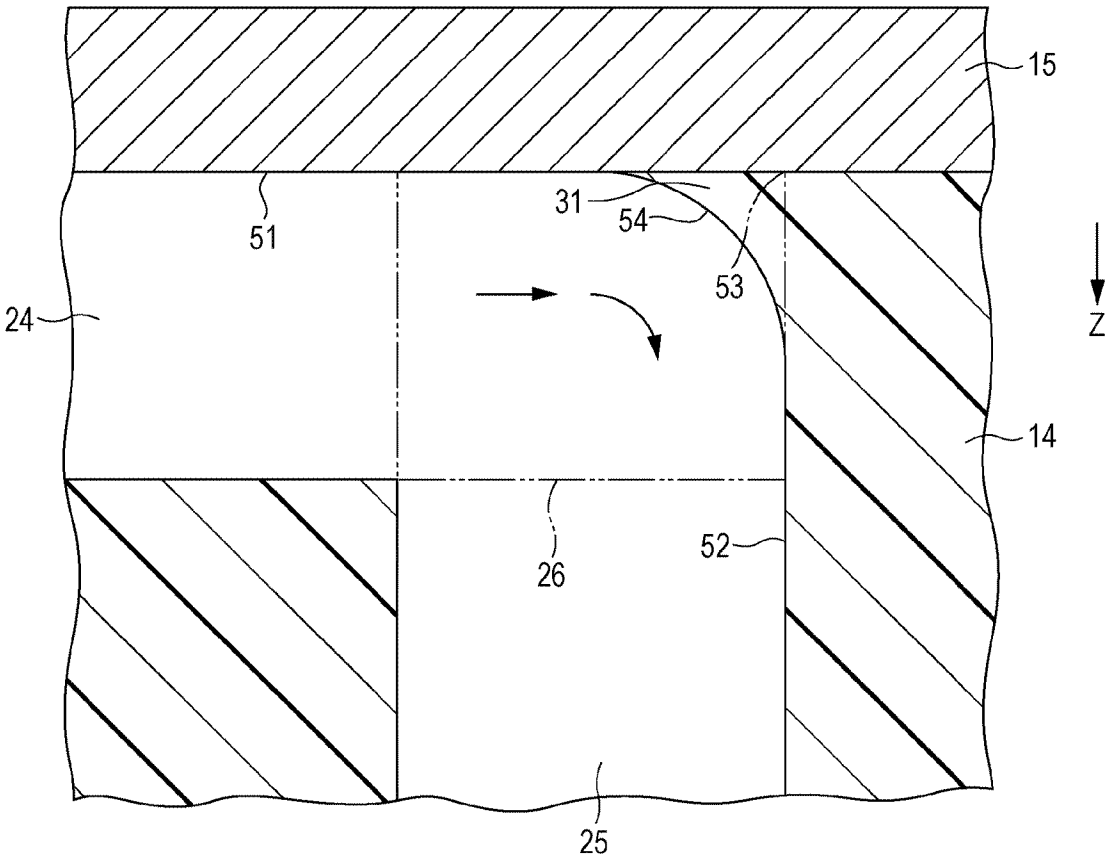
FIG. 7 is an illustrative view of the flow of liquid in a curved section in the first embodiment.

The foregoing head unit 2 in the first embodiment produces effects that will be described below. With reference to FIGS. 4, 6, and 7, a description will be given below of the flow of ink in the curved section 26 and effects of the cover section 31. FIG. 6 illustrates the flow of ink in a configuration in which no cover section 31 is formed. As illustrated in FIG. 6, ink flows along a first channel 24 in the X direction, then reaches an inside wall 52 of a second channel 25, and the ink changes its flow direction. In this case, since the inside wall 52 of the second channel 25 extends in the Z direction, a part of the ink that has reached the inside wall 52 of the second channel 25 flows toward the upper sealing substrate 15. Therefore, the entire ink that has reached the inside wall 52 is not guided smoothly to the communicating substrate 16 (FIG. 3) and some of the ink rather stays in a corner portion 53 of a curved section 26.

In contrast, the head unit 2 in the first embodiment has a cover section 31 as illustrated in FIG. 7. When ink that has flown along a first channel 24 in the X direction reaches a wall 54 of the cover section 31, the ink changes its flow direction. The wall 54 of the cover section 31 intersects both the X and Z directions, and thus the ink is guided in the curved section 26 smoothly to the communicating substrate 16 along the wall 54 of the cover section 31, or in the Z direction. Consequently, when the flow of the ink changes from the X direction to the Z direction, the ink is less likely to stay in the corner portion 53. Therefore, assuming that bubbles are generated in a channel, the bubbles pass smoothly through a curved section 26 in the channel along with the ink flow. Thus, bubbles generated in a channel are purged readily through nozzles 32.

As illustrated in FIG. 4, the wall 54 in the cover section 31 in the first embodiment has a curved surface. By forming the wall surface of the cover section 31 into a curved shape such that its orientation changes gradually, the ink is guided smoothly so as to flow in the Z direction. Therefore, the head unit 2 is highly effective in causing ink to flow smoothly without staying in the corner portion 53. The surface of the wall 54 is preferably incurved in the X and -Z directions. The ink is thereby guided more smoothly so as to flow along the incurved surface of the wall 54 and in the Z direction.

In the first embodiment, a height H3 of the wall 54 in the cover section 31 in the Z direction is preferably equal to one-quarter a height H1 of a first channel 24 in the Z direction or more than one-quarter the height H1 of the first channel 24 in the Z direction. This configuration can guide the ink more smoothly in the curved section 26 so as to flow along the wall 54 in the cover section 31 and in the Z direction. Further, the height H3 more preferably exceeds one-half the height H1. This configuration can guide the ink in the Z direction at a higher rate. It should be noted that the first embodiment employs the configuration in which the height H3 exceeds one-half the height H1.

According to the foregoing first embodiment, when the flow of the ink changes from the X direction to the Z direction in the curved section 26, the ink is less likely to stay in the corner portion 53. Therefore, assuming that bubbles are generated in a channel, the bubbles pass through a curved section 26 in the channel smoothly along with the ink flow. The bubbles that have been generated in the channel are thereby purged readily through the nozzles 32. Consequently, it is possible to provide a head unit 2 from which bubbles generated in a channel continuing to nozzles 32 can be purged readily.

Second Embodiment

Figure 8:
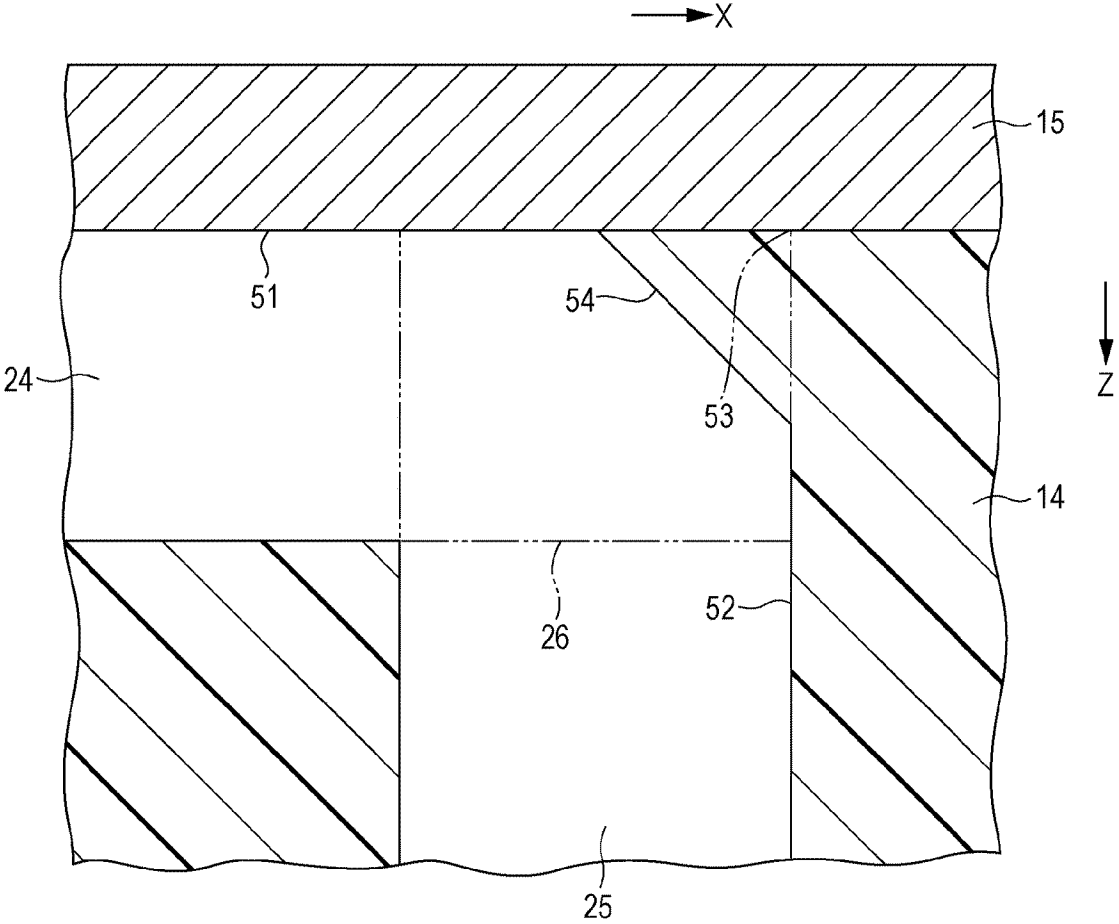
FIG. 8 is an enlarged sectional view of a curved section in a second embodiment of the invention.

FIG. 8 is an enlarged sectional view of a curved section 26 in a second embodiment of the invention. With reference to FIG. 8, a head unit 2 in the second embodiment will be described. Constituent elements that are the same as in the first embodiment are denoted by the same reference characters and will not be described.

Referring to FIG. 8, the cover section 31 in the second embodiment has a wall 54 with a flat surface.

In addition to the effect of the first embodiment, the head unit 2 in the second embodiment produces an effect that it is possible to control the shape of the cover section 31 easily. Since the wall 54 in the cover section 31 in the first embodiment has a curved surface whose orientation gradually changes, it may be difficult to reliably form the wall 54 and measure this shape. In contrast, the wall 54 in the cover section 31 in the second embodiment has a flat surface, it is possible to form the wall 54 accurately in a manufacturing process and measure this shape precisely in an inspecting process. With this precise measurement, the effect produced by the cover section 31 of this shape can be ensured easily.

The foregoing first and second embodiments of the invention are exemplary and can be modified in various ways. Some modifications will be described below.

Modification 1

Figure 9:
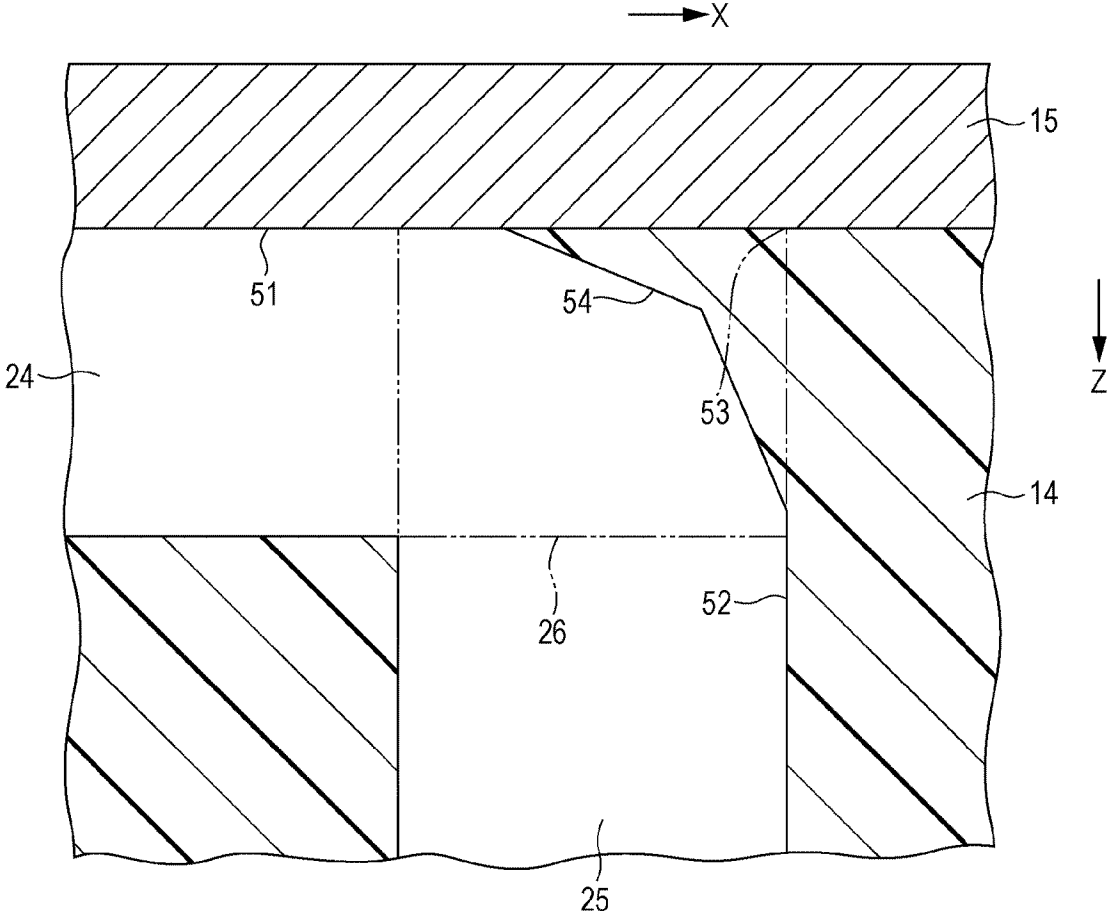
FIG. 9 is an enlarged sectional view of a curved section in modification 1 of the first and second embodiments.

FIG. 9 is an enlarged sectional view of a curved section 26 in modification 1 of the first and second embodiments. In the first and second embodiments, the wall 54 in the cover section 31 has a single surface as illustrated in FIG. 4; however, this configuration is exemplary. A head unit 2 in modification 1 will be described below. Constituent elements that are the same as in the first embodiment are denoted by the same reference characters and will not be described.

As illustrated in FIG. 9, a wall 54 in the cover section 31 in modification 1 has two surfaces. One of the surfaces of the wall 54 in the cover section 31 intersects the X direction, whereas the other one thereof intersects the Z direction. Examples of the combination of the surfaces include the combination of curved surfaces, the combination of flat surfaces, and the combination of curved and flat surfaces. The wall 54 in the cover section 31 may have three or more surfaces.

In addition to the effects of the first and second embodiments described above, the head unit 2 in modification 1 produces the following effect. The wall 54 in the cover section 31 in modification 1 has two flat surfaces. In this case, ink flows along a first channel 24 in the X direction and then its flow direction is changed by the two flat surfaces of the wall 54 in the cover section 31. The ink thereby flows along the wall surfaces of the cover section 31 in the curved section 26. Thus, the wall 54 can guide the ink in the Z direction more readily than a wall 54 having a single surface. Therefore, assuming that bubbles are generated in a channel, the bubbles pass through a curved section 26 in the channel smoothly along with the ink flow. The bubbles that have been generated in the channel are thereby purged readily through nozzles 32. Consequently, it is possible to provide a head unit 2 from which bubbles generated in a channel continuing to nozzles 32 can be purged readily.

Modification 2

Figure 10:
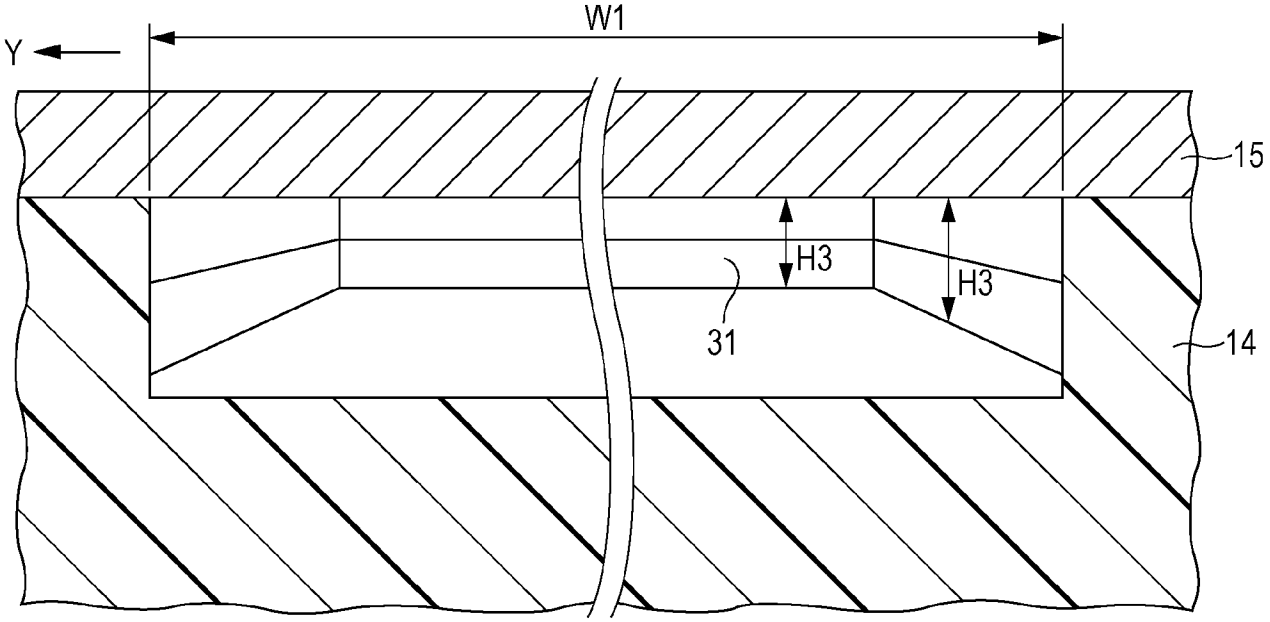
FIG. 10 is a sectional view of a curved section in modification 2 taken along the line X-X in FIG. 4.

FIG. 10 is a sectional view of a curved section 26 in modification 2 taken along the line X-X in FIG. 4. In the foregoing first and second embodiments and modification 1, the sectional shape of the wall 54 in the cover section 31 and a height H3 of the sectional shape of the cover section 31 do not change in the Y direction as illustrated in FIG. 5; however, this configuration is exemplary. A head unit 2 in modification 2 will be described below. Constituent elements that are the same as in the first embodiment are denoted by the same reference characters and will not be described.

As illustrated in FIG. 10, the sectional shape of a wall 54 in a cover section 31 in modification 2 and a height H3 of the sectional shape of a cover section 31 change in the Y direction.

In addition to the effects of the first and second embodiments and modification 1 described above, the head unit 2 in modification 2 produces the following effect. The wall 54 in the cover section 31 in modification 2 has a sectional shape that changes in the Y direction. Moreover, a height H3 of the sectional shape of the cover section 31 increases with distance from an ink introducing path 28. In FIG. 5, the first channel 24 has a width W1 in the curved section 26, and thus extends evenly in the Y direction from the ink introducing path 28 to the curved section 26. If the height H3 of the sectional shape of the cover section 31 is uniform in the Y direction as illustrated in FIG. 5, the ink may flow at a lower rate within regions in the curved section 26 which are away from the ink introducing path 28 in the Y direction. The regions in which the ink flows at a lower rate correspond to those in which the ink stagnates. In the case where the height H3 of the sectional shape of the cover section 31 is uniform in the Y direction, the flow rate, or stagnation, of the ink is distributed unevenly across the cover section 31 in the Y direction. In modification 2, however, the height H3 of the sectional shape of the cover section 31 changes in accordance with the stagnant distribution. More specifically, the height H3 increases in the curved section 26 at sites where the ink would stagnate largely, whereby the ink is guided smoothly in the Z direction at these sites of the curved section 26. Therefore, assuming that bubbles are generated in a channel, the bubbles pass through a curved section 26 in the channel smoothly along with the ink flow. The bubbles that have been generated in the channel are thereby purged readily through nozzles 32. Consequently, it is possible to provide a head unit 2 from which bubbles generated in a channel continuing to nozzles 32 can be purged readily.

Modification 3

Figure 11:
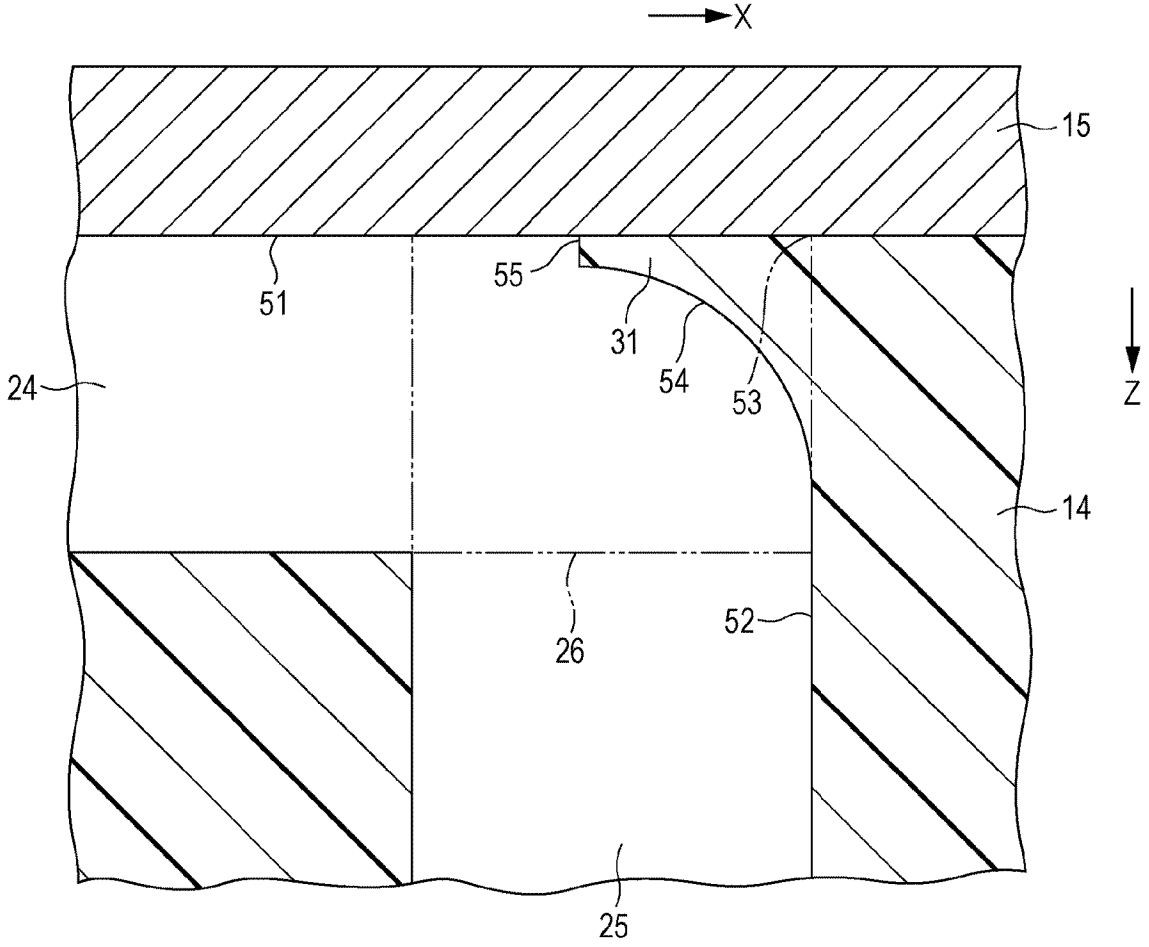
FIG. 11 is an enlarged sectional view of a curved section in modification 3 of the first and second embodiments.

FIG. 11 is an enlarged sectional view of a curved section 26 in modification 3 of the first and second embodiments. In the foregoing first and second embodiments and modifications 1 and 2, the wall 54 in the cover section 31 intersects both the X and Z directions as illustrated in FIG. 4; however, this configuration is exemplary. A head unit 2 in modification 3 will be described below. Constituent elements that are the same as in the first embodiment are denoted by the same reference characters and will not be described.

As illustrated in FIG. 11, a cover section 31 in modification 3 has a step 55 at its end closer to a first channel 24. In this case, a wall 54 in the cover section 31 intersects in both the X and Z directions, but the step 55 intersects only the X direction.

In addition to the effects of the first and second embodiments and modifications 1 and 2 described above, the head unit 2 in modification 3 produces the following effect. By forming the step 55 in the cover section 31 at an end closer to the first channel 24, the cover section 31 is made more robust. This can reduce the risk that the cover section 31 is deformed or cracks due to stress. Moreover, it is also possible to reduce the risk that the deformation of the cover section 31 lowers the effects of the head unit 2 or foreign matters enter the channel through the crack of the cover section 31 and clog the channel. Consequently, modification 3 provides a head unit 2 that can print images more reliably.

What is claimed is:

1. A liquid ejecting head comprising:

a plurality of substrates stacked in a stacking direction, the substrates including a nozzle substrate having a nozzle formed therein, liquid being ejected from the nozzle;

a channel formed in at least a part of the plurality of substrates, the channel guiding the liquid to the nozzle, the channel including:

a first channel extending in a first direction intersecting the stacking direction;

a curved section curved in a second direction, the second direction intersecting the first direction, the second direction containing a component of the stacking direction;

a second channel extending from the curved section in the second direction; and a third channel extending from the second channel to the nozzle;

wherein the curved section has a wall formed in a corner portion, the wall intersecting both the first direction and the second direction, and wherein the second channel is closer to the nozzle than the first channel in the channel.

2. The liquid ejecting head according to claim 1, wherein a width of the wall in a direction intersecting the first direction when the wall is viewed as a plane from the stacking direction is larger than both a width of the first channel in the second direction and a width of the second channel in the first direction.

3. A liquid ejecting apparatus comprising the liquid ejecting head according to claim 2.

4. The liquid ejecting head according to claim 1, wherein the second direction is the stacking direction.

5. A liquid ejecting apparatus comprising the liquid ejecting head according to claim 4.

6. The liquid ejecting head according to claim 1, wherein when the first channel, the curved section, and the second channel are cut along a plane defined by the first direction and the second direction, a width of a cross section of the wall in the second direction is equal to one-quarter a width of a cross section of the first channel in the second direction or exceeds one-quarter the width of the cross section of the first channel in the second direction.

7. A liquid ejecting apparatus comprising the liquid ejecting head according to claim 6.

8. The liquid ejecting head according to claim 1, wherein the plurality of substrates include a resin substrate made of a resin material, and at least a part of the first channel, the curved section, and at least a part of the second channel are formed in the resin substrate.

9. A liquid ejecting apparatus comprising the liquid ejecting head according to claim 8.

10. The liquid ejecting head according to claim 1, wherein the wall has a curved surface.

11. A liquid ejecting apparatus comprising the liquid ejecting head according to claim 10.

12. The liquid ejecting head according to claim 1, wherein the wall has a flat surface.

13. A liquid ejecting apparatus comprising the liquid ejecting head according to claim 12.

14. A liquid ejecting apparatus comprising the liquid ejecting head according to claim 1.

* * * * *